US006909867B2

(12) United States Patent
Mishra et al.

(10) Patent No.: US 6,909,867 B2
(45) Date of Patent: Jun. 21, 2005

(54) UNIFORM CHARGE DEVICE WITH REDUCED EDGE EFFECTS

(75) Inventors: Satchidanand Mishra, Webster, NY (US); Edward A. Domm, Hilton, NY (US); Dennis J. Prosser, Walworth, NY (US); Steven P. Nonkes, Monrovia, MD (US); Zoran D. Popovic, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/652,107

(22) Filed: Aug. 29, 2003

(65) Prior Publication Data

US 2004/0105701 A1 Jun. 3, 2004

Related U.S. Application Data

(60) Provisional application No. 60/407,215, filed on Aug. 29, 2002.

(51) Int. Cl.[7] ..... G03G 15/02
(52) U.S. Cl. ..... 399/173; 399/171; 399/172
(58) Field of Search ..... 250/324, 325, 250/326; 361/220, 222, 223, 225, 230; 399/168, 170, 171, 172, 173

(56) References Cited

U.S. PATENT DOCUMENTS

| | | | | |
|---|---|---|---|---|
| 1,959,154 A | | 5/1934 | Bremer | |
| 2,777,957 A | | 1/1957 | Walkup | |
| 2,965,754 A | | 12/1960 | Bickmore et al. | |
| 3,888,578 A | | 6/1975 | Eto | |
| 3,937,960 A | | 2/1976 | Matsumoto et al. | |
| 4,112,299 A | | 9/1978 | Davis | |
| 4,344,104 A | | 8/1982 | Habets et al. | |
| 4,456,365 A | | 6/1984 | Yuasa | |
| 4,638,397 A | | 1/1987 | Foley | |
| 5,025,155 A | | 6/1991 | Hattori | |
| 5,324,942 A | | 6/1994 | Mishra et al. | |
| 6,070,033 A | * | 5/2000 | Hiraoka et al. | 399/170 |
| 6,185,397 B1 | | 2/2001 | Kumar et al. | |

FOREIGN PATENT DOCUMENTS

| | | |
|---|---|---|
| EP | 0 274 894 | 7/1988 |
| EP | 0 917 012 | 5/1999 |

* cited by examiner

*Primary Examiner*—Hoang Ngo
(74) *Attorney, Agent, or Firm*—David E. Henn

(57) ABSTRACT

By varying corona producing element height/projection, a more uniform charge potential is achieved. Elements, such as pins or teeth, are shorter at the edges of an element array and grow longer as one moves toward the center of the array. Such variation in height/projection overcomes shielding from adjacent teeth, as well as other effects, to yield the more uniform charging potential.

27 Claims, 5 Drawing Sheets

UNIFORM CHARGE DEVICE WITH REDUCED EDGE EFFECTS

CROSS-REFERENCE TO RELATED APPLICATIONS

This application is based on a Provisional Patent Application No. 60/407,215, filed Aug. 29, 2002.

FIELD OF THE INVENTION

The invention relates to corona producing apparatus.

BACKGROUND AND SUMMARY

Electroreprographic systems, and xerographic systems in particular, use corona producing devices to produce electric fields to, for example, charge retentive photoresponsive surfaces, such as photoreceptor belt or drum surfaces. Various types of such corona charge generating devices include wires, while others include pins or teeth. In all cases, charge uniformity is desirable, and various solutions have been presented to make the fields produced by corona charge generating devices more uniform. U.S. Pat. Nos. 5,324,942, 2,777,957, 2,965,754, 3,937,960, 4,112,299, 4,456,365, 4,638,397, and 5,025,155 disclose various prior art corona charge producing devices; the disclosures of these patents are incorporated by reference into the disclosure of the instant patent application. Xerox Disclosure Journal (Vol. 10, No. 3; May/June 1985) teaches, at pp. 139–140, an alternate approach; the disclosure of this article is also incorporated by reference into the instant patent application.

FIG. 3 shows a typical prior art saw tooth corona producing array in which all teeth project the same amount toward the photoreceptor. Such a uniform amount of tooth projection yields a non-uniform charging potential profile, as seen in FIG. 4, with teeth toward the center of the array having a decreasing contribution. As illustrated by these FIGS. and by the disclosures of the references mentioned above, current design of saw tooth and pin array based corona producing devices are prone to non-uniform charging patterns. Referring to the pins and teeth of such devices as elements, we see that this variation in charging pattern is due to a fundamental problem that causes the electric field to be highest at the edge elements. This is due in part to shielding effects evinced by adjacent elements, so that as one examines the field produced by elements toward the center of an array, one sees lower values since the field from other elements is blocked by the presence of intervening elements. The corona supply therefore is highest near the edge of the charging device. If the print area near the edges is not carefully selected, a dark edge may result in the print.

This effect can be understood from the symmetry and shielding of electric field by neighboring elements. The elements that lie inside the array have symmetrical flow of corona current on both sides, but the elements that lie near the edges have corona current only on one side of the pins. The electric field at the heads of inside elements, therefore, is reduced. As the voltage applied to the array is raised, the outside elements begin to glow first because the threshold field for air breakdown is reached there first. With further rise of voltage, other elements also glow, but the respective current is lower. This can be seen in the lower intensity of glow at these elements. The voltage profile deposited by a corotron or scorotron with such a uniform element projection profile has peaks under the outside edges.

To overcome such non-uniform voltage profiles, embodiments provide a charging apparatus that applies a substantially uniform charge to a charge retentive surface. The apparatus comprises a corona producing device, spaced from the charge retentive surface, that emits corona ions, but with corona producing elements of varying heights. The height of the elements near the edges is reduced so that the distance between the surface to be charged and the ends of the edge elements is greater than that between the surface to be charged and the ends of the inner elements. The actual height is found, for example, by iterative calculation as will be shown below.

While exemplary embodiments will be described, there is no intent to limit the invention to the embodiments described. On the contrary, the intent is to cover all alternatives, modifications, and equivalents as may be included within the spirit and scope of the invention as defined by the appended claims.

DESCRIPTION

Figure 1:
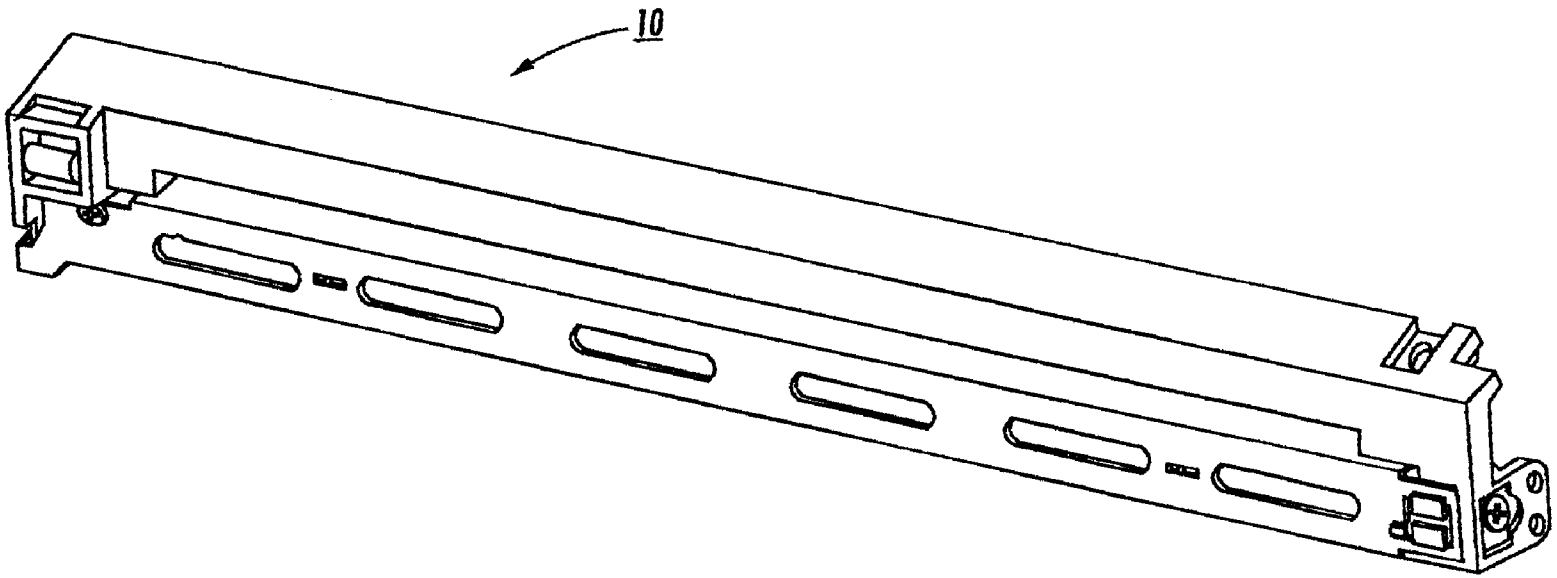
FIG. 1 is an exemplary schematic elevational view of an exterior of a charge device according to embodiments.

For a general understanding of the present invention, reference is made to the drawings. In the drawings, like reference numerals have been used throughout to designate identical elements. FIG. 1 shows a schematic elevational view of a charge device 10 including features of embodiments. Such a device is used in marking machines, such as a printer or photocopier (not shown), to charge a photoresponsive belt (not shown). The charge device can be, for example, a scorotron. From the outside, embodiments appear similar to the prior art.

Figure 2:
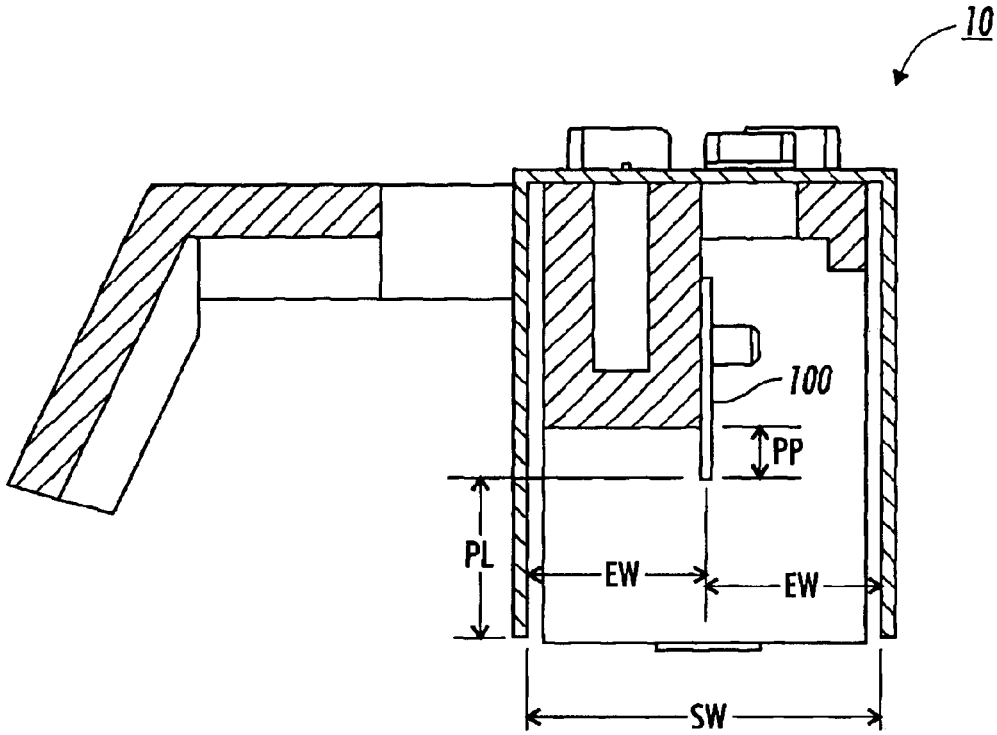
FIG. 2 is a schematic cross-section of the device shown in FIG. 1.
Figure 3:
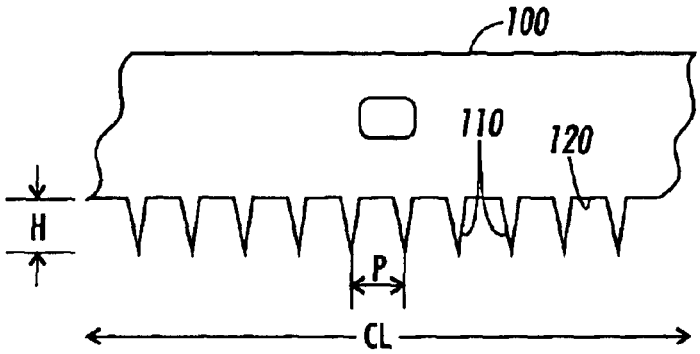
FIG. 3 (PRIOR ART)
FIG. 3 is a schematic plan view of a prior art charge device plate with uniform charge producing elements in the form of saw teeth.
Figure 4:
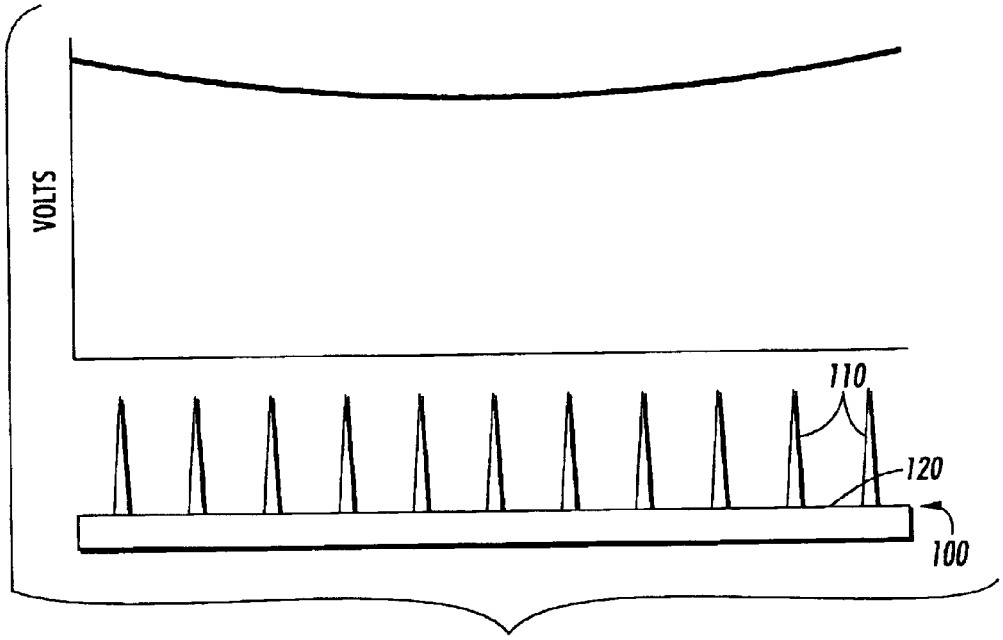
FIG. 4 (PRIOR ART)
FIG. 4 is a schematic view of the prior art charge device plate and showing the fluctuation of voltage along the plate.

Referring particularly now to FIGS. 2–4, the housing supports a charge producing array 100 that is connected to a power source. In prior art devices, the plate 100 included charge producing elements 110 with uniform height H and equal gaps 120 therebetween yielding a uniform pitch P, as illustrated in FIG. 3. However, as described above, because of such factors as shielding by adjacent and outer elements, grid distance to elements, alignment, and material characteristics of individual elements 110, a uniform charging potential may not be realized on the photoreceptor, as schematically shown in FIG. 4.

The present invention is an apparatus that improves on prior art solutions, such as altering the relative spacing between a flexible scorotron grid and a charge retentive surface, such as a photoreceptor, to achieve a more uniform charge density and charge potential profile across the usable portion of the surface. More specifically, the corona producing elements in a corona producing/charge producing array, be they pins, teeth, or the like, have varying heights to achieve a more uniform charge density and potential profile. Elements toward a center of the array are taller than elements toward edges of the array to overcome shielding and other effects.

Embodiments include at least one array 100 of elements 110, comprising at least one plurality of corona producing elements 110 directed at and spaced from a charge retentive surface, such as a photoreceptor belt. The elements 110 are arranged in a profile that reduces shielding effects, and are connected to a power source. The array is supported in a housing that can be mounted in an electrophotographic marking device, such as a xerographic multifunction device.

Figure 5:
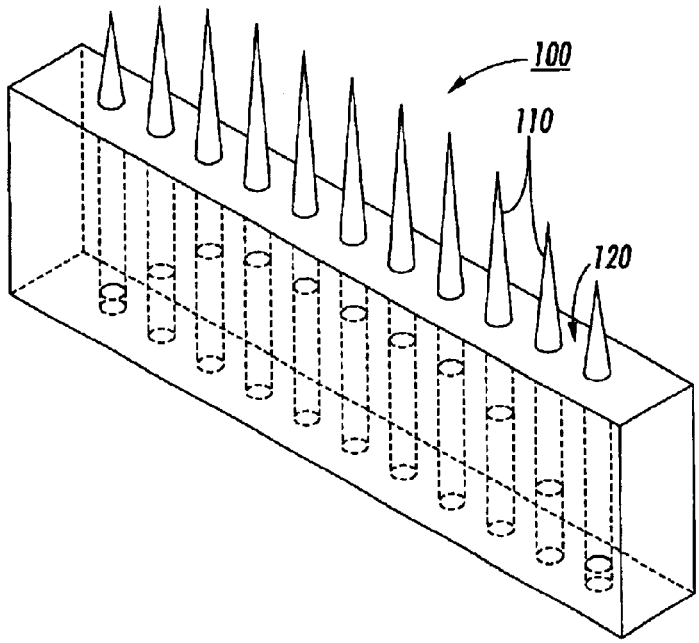
FIG. 5 is a schematic view of an exemplary charge device array using charge producing elements in the form of pins.
Figure 6:
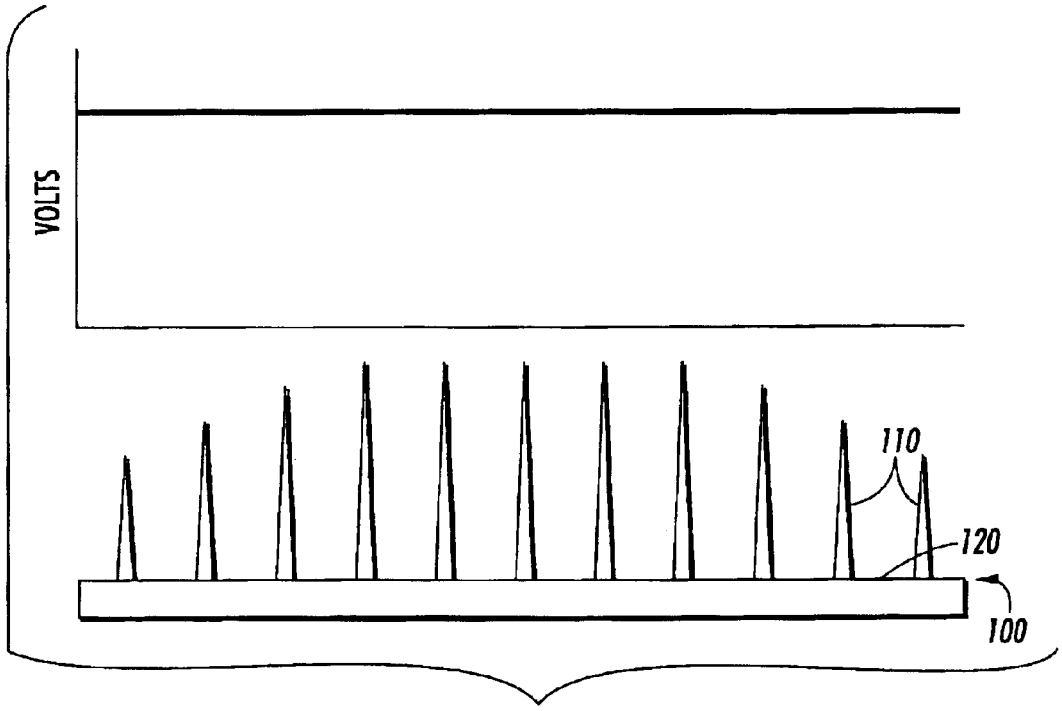
FIG. 6 is a schematic illustration of the charge distribution achieved by embodiments.

As seen in FIG. 5, the at least one plurality of corona producing elements 110 can include an array of pins projecting toward the charge retentive surface, with pins at edges of the array projecting less than pins toward a center of the array. The array of pins can be arranged in a line with pins projecting further toward the charge retentive surface in accordance with their proximity to a center of the line of pins. The pins can be held in a support 130, such as a block that can include bores into which the pins are inserted and in which the pins are held. The depth of pin insertion can be varied to adjust the degree to which the pins project toward the charge retentive surface, or pins of different lengths can be inserted to the same depth. Additionally, the array of pins further can include at least one additional line of pins substantially parallel to the first line of pins and whose pins project further toward the charge retentive surface in accordance with their proximity to edges of the additional line(s) of pins. To accommodate additional effects on the corona and charge profile, the degree of projection of the pins in the lines of pins can vary with the line of pins in which the pins are located. When the proper profile is applied to the elements 110, the charging potential is much more uniform, as illustrated schematically in FIGS. 6 and 7.

Figure 7:
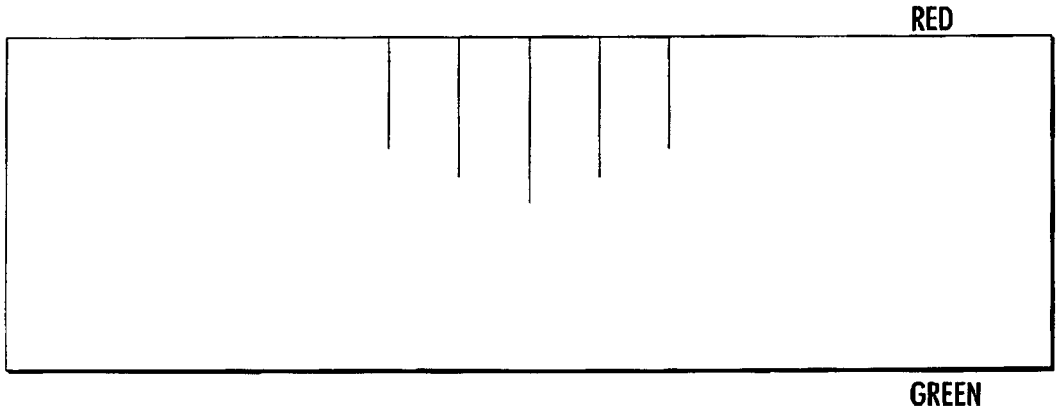
FIG. 7 is another schematic illustration of charge distribution achieved by embodiments.
Figure 8:
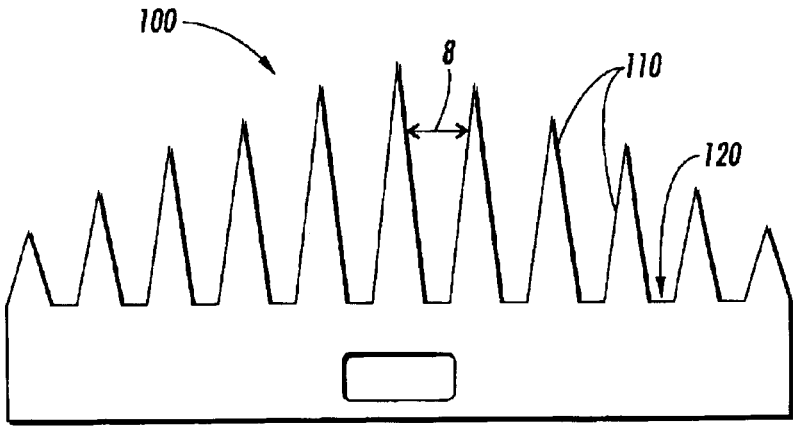
FIG. 8 is a schematic view of an exemplary charge device array using charge producing elements in the form of saw teeth.
Figure 9:
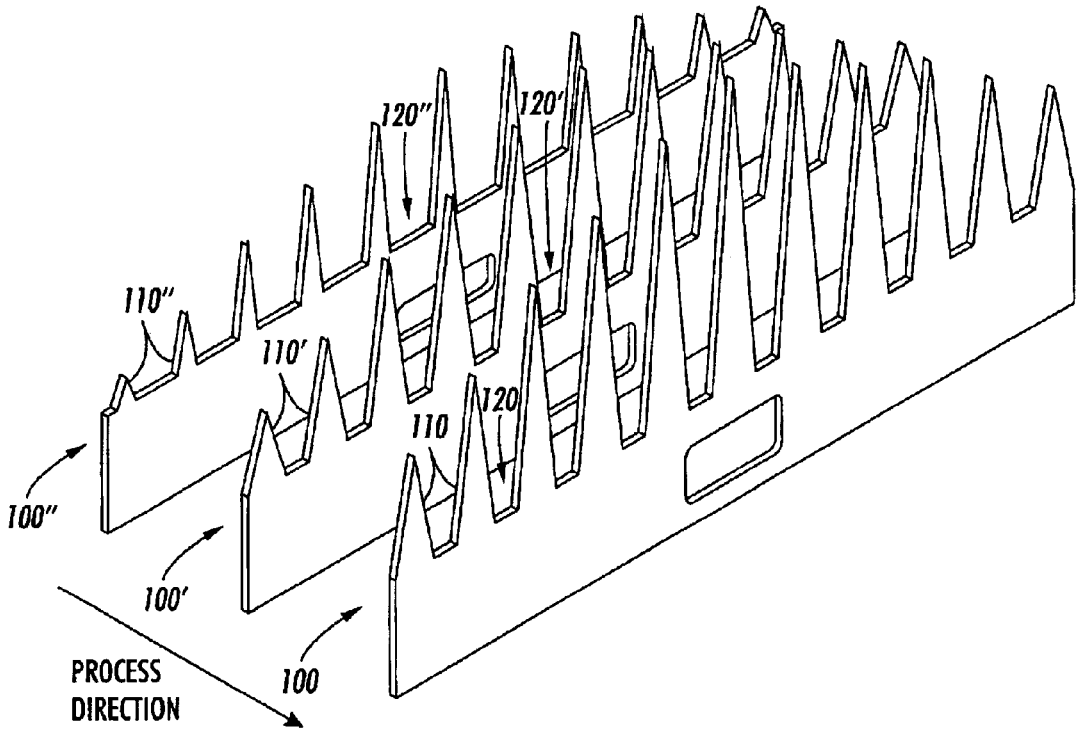
FIG. 9 is a schematic illustration of a plurality of charge device arrays arranged along the process direction according to embodiments.

As an example of an alternative to pins for the corona producing elements, the at least one plurality of corona producing elements can comprise an array of teeth projecting toward the charge retentive surface, as seen in FIG. 8, with teeth at edges of the array project less than teeth toward a center of the array. Such an array of teeth can comprise a line of teeth with teeth projecting further toward the charge retentive surface in accordance with their proximity to a center of the line of teeth, and the teeth can include teeth of a sawtooth configuration. Arrays of teeth can be, for example, stamped from sheet of metal. As with the pin array, the charging potential exhibited by the saw tooth array can be much more uniform, as illustrated schematically in FIGS. 6 and 7, when an appropriate tooth projection/height profile is used.

Determining the potential at points throughout the region between a charge, producing array in, for example, a corotron, and the photoreceptor of a marking machine involves calculating the potential in one area as being equal to the average of the potential in the regions adjacent to this area. For example, in the sample field shown in Table I, the potential of areas F would be equal to the average of the potentials in areas B, E, G and J. The potential of area J would be equal to the average of the potentials in areas F, I, K and N.

TABLE I

| Sample Field for Calculations | | | |
|---|---|---|---|
| A | E | I | M |
| B | F | J | N |
| C | G | K | O |
| D | H | L | P |

Performing a large number of iterations will yield a sufficiently accurate representation of the potential at areas throughout the region between the corotron and the surface.

In the calculations performed, the corotron elements were assumed to be at one potential and the surface was assumed to be at another potential. The ends of the region were set up to display a reflection of the potential of the region. In FIG. 7, the red members were given the corotron voltage value, the green member was assigned the surface voltage value, and the black members were reflecting the voltage of the region of calculation.

The program used to perform the calculations was also programmed to provide a rough estimation of the magnitude of the electric field at each point by averaging the absolute value of the difference between the potential of each point and the points adjacent to that point. For example, this quantity for point F in Table I would be the average of the difference in potential between points F and B, points F and E, points F and G, and points F and J. This data was used to generate plots of the relative gradient throughout the region between the corotron and the surface. In these calculations, the mesh size unit has been assumed to be of unit length.

$$G_F = \frac{|V_F - V_D| + |V_F - V_E| + |V_F - V_G| + |V_F - V_J|}{4} \quad \text{Eq. 4}$$

More generally, this formula can be expressed as:

$$G_{x,y} = \frac{|V_{x,y} - V_{x-1,y}| + |V_{x,y} - V_{x,y-1}| + |V_{x,y} - V_{x,y+1}| + |V_{x,y} - V_{x+1,y}|}{4} \quad \text{Eq. 5}$$

where (x,y) represent the matrix coordinates of the pin of interest.

Whatever the type of corona producing elements employed, the profile is determined, for example, by iterative adjustment of the elements of the at least one plurality of corona producing elements so that an electric field at substantially all points is substantially equal. In particular, the profile can be determined by applying the formula:

$$G_{x,y} = \frac{|V_{x,y} - V_{x-1,y}| + |V_{x,y} - V_{x,y-1}| + |V_{x,y} - V_{x,y+1}| + |V_{x,y} - V_{x+1,y}|}{4},$$

where (x,y) represent matrix coordinates of a point of interest, and $G_{x,y}$ is an electric field at the point of interest, to achieve a substantially uniform value of G for all points (x,y) between the at least one corona producing element and the charge retentive surface.

Thus, to substantially uniformly charge a charge retentive surface, one can attach at least one plurality of corona charging elements to a power source and determine a respective electric field distribution over each plurality of the at least one plurality of corona charging elements using, for example, the formula above. If the respective electric field is substantially non-uniform, then one adjusts the degree of projection of the elements of the respective at least one plurality of corona charging elements. These actions would be repeated until each respective electric field, and the overall field, is substantially uniform.

While this invention has been described in conjunction with preferred embodiments thereof, many alternatives, modifications, and variations may arise that are not currently foreseeable to those skilled in the art. Accordingly, it is intended to embrace all such alternatives, modifications and variations that fall within the spirit and broad scope of the appended claims.

What is claimed is:

1. A corona producing device comprising:

at least one plurality of corona producing elements arranged in an array, the array of elements projecting toward and spaced from a charge retentive surface, where elements at edges of the array project less than elements toward a center of the array, and wherein the array of elements is arranged in a profile that reduces shielding effects;

a power source connected to the at least one plurality of corona producing elements; and supports to which the at least one plurality of corona producing elements are attached.

2. The device of claim 1 wherein the at least one plurality of corona producing elements includes an array of pins.

3. The device of claim 2 wherein the array of pins comprises a line of pins with pins projecting further toward the charge retentive surface in accordance with their proximity to a center of the line of pins.

4. The device of claim 2 wherein the pins are held in a block.

5. The device of claim 4 wherein the block includes bores into which the pins are inserted and in which the pins are held.

6. The device of claim 5 wherein the depth of pin insertion can be varied to adjust the degree to which the pins project toward the charge retentive surface.

7. The device of claim 3 wherein the array of pins further comprises at least one additional substantially parallel line of pins whose pins project further toward the charge retentive surface in accordance with their proximity to edges of the at least one substantially parallel line of pins.

8. The device of claim 7 wherein the degree of projection of the pins in the lines of pins also varies with the line of pins in which the pins are located.

9. The device of claim 1 wherein the at least one plurality of corona producing elements comprises an array of teeth.

10. The device of claim 9 wherein the array of teeth comprises a line of teeth with teeth projecting further toward the charge retentive surface in accordance with their proximity to a center of the line of teeth.

11. The device of claim 10 wherein the line of teeth includes teeth of a substantial sawtooth configuration.

12. The device of claim 10 wherein the line of teeth comprises a stamped sheet of metal.

13. The apparatus of claim 1 wherein the profile is determined by iterative adjustment of the elements of the at least one plurality of corona producing elements so that an electric field at substantially all points is substantially equal.

14. The device of claim 13 wherein the profile is determined by applying the formula:

$$G_{x,y} = \frac{|V_{x,y} - V_{x-1,y}| + |V_{x,y} - V_{x,y-1}| + |V_{x,y} - V_{x,y+1}| + |V_{x,y} - V_{x+1,y}|}{4},$$

where (x,y) represent matrix coordinates of a point of interest, and $G_{x,y}$ is an electric field at the point of interest, to achieve a substantially uniform value of G for all points (x,y) between the at least one corona producing element and the charge retentive surface.

15. A charging apparatus in the form of a corona producing device and including a plurality of elements projecting toward a charge retentive surface, elements toward a center of the plurality of elements projecting further toward the charge retentive surface than elements toward edges of the plurality of elements, at least one element at the center projecting most toward the charge retentive surface, and elements at the edges projecting least toward the charge retentive surface.

16. The apparatus of claim 15 wherein the elements in the plurality of elements are arranged in a line.

17. The apparatus of claim 15 wherein the plurality of elements include at least two lines of elements.

18. The apparatus of claim 17 wherein a degree of projection of each element also varies with the line in which it resides.

19. The apparatus of claim 15 wherein the elements are pins.

20. The apparatus of claim 19 wherein the pins are held in a block.

21. The apparatus of claim 20 wherein the pins reside in respective bores and the degree of projection of each pin can be varied by varying how far each pin is inserted into its respective bore.

22. The apparatus of claim 15 wherein a degree of projection of the plurality of elements is determined at least in part according to iterative application of the formula:

$$G_{x,y} = \frac{|V_{x,y} - V_{x-1,y}| + |V_{x,y} - V_{x,y-1}| + |V_{x,y} - V_{x,y+1}| + |V_{x,y} - V_{x+1,y}|}{4}$$

where (x,y) represent matrix coordinates of a pin of interest, and $G_{x,y}$ is an electric field at the pin of interest, to achieve a substantially uniform value of G for all points (x,y) in the plurality of pins.

23. A method of substantially uniformly charging a charge retentive surface comprising:

attaching at least one plurality of corona charging elements to a power source;

determining a respective electric field distribution over each plurality of the at least one plurality of corona charging elements;

if the respective electric field is substantially non-uniform, adjusting the elements of the respective at least one plurality of corona charging elements; and repeating the determining and adjusting until each respective electric field is substantially uniform.

24. The method of claim 23 wherein attaching at least one plurality of corona charging elements to a power source includes mounting each plurality of elements on a conductive surface and substantially perpendicular to the conductive surface so as to project toward the charge retentive surface.

25. The method of claim 24 further comprising sizing elements on an edge of a plurality of elements to project less than elements toward a center of the plurality.

26. The method of claim 24 further comprising altering a curvature of the conductive surface so that elements at an edge of a plurality of elements are farther from the charge retentive surface than elements toward a center of the plurality.

27. The method of claim 24 wherein determining the electric field of each plurality of elements includes applying the formula:

$$G_{x,y} = \frac{|V_{x,y} - V_{x-1,y}| + |V_{x,y} - V_{x,y-1}| + |V_{x,y} - V_{x,y+1}| + |V_{x,y} - V_{x+1,y}|}{4},$$

where (x,y) represent matrix coordinates of a pin of interests and $G_{x,y}$ is an electric field at the pin of interest, to achieve a substantially uniform value of G for all points (x,y) in the plurality of pins.

* * * * *